US008500202B2

(12) United States Patent
Nielsen et al.

(10) Patent No.: US 8,500,202 B2
(45) Date of Patent: Aug. 6, 2013

(54) PIECE OF FURNITURE SUCH AS A BED OR A CHAIR

(75) Inventors: Jens Jørgen Nielsen, Broager (DK); Kurt Lorenzen, Broager (DK)

(73) Assignee: Linak A/S, Nordborg (DK)

( * ) Notice: Subject to any disclaimer, the term of this patent is extended or adjusted under 35 U.S.C. 154(b) by 676 days.

(21) Appl. No.: 12/223,931

(22) PCT Filed: Feb. 15, 2007

(86) PCT No.: PCT/DK2007/000073

§ 371 (c)(1),
(2), (4) Date: Aug. 13, 2008

(87) PCT Pub. No.: WO2007/093178

PCT Pub. Date: Aug. 23, 2007

(65) Prior Publication Data

US 2010/0313690 A1 Dec. 16, 2010

(30) Foreign Application Priority Data

Feb. 17, 2006 (DK) ..... 2006 00226

(51) Int. Cl.
*A47C 1/02* (2006.01)

(52) U.S. Cl.
USPC ..... 297/316; 297/362.14; 297/330; 5/616; 5/618

(58) Field of Classification Search
USPC ..... 5/616, 613, 617, 618; 297/86, 316, 297/330, 362.14; 74/89.32, 102
See application file for complete search history.

(56) References Cited

U.S. PATENT DOCUMENTS

| | | | | |
|---|---|---|---|---|
| 4,381,571 | A * | 5/1983 | Elliott | 5/616 |
| 5,675,849 | A * | 10/1997 | Koch | 5/616 |
| 5,853,186 | A * | 12/1998 | Gentner et al. | 280/491.3 |
| 5,927,144 | A * | 7/1999 | Koch | 74/89.36 |
| 6,300,732 | B1 * | 10/2001 | Brambilla | 318/9 |
| 6,679,555 | B2 * | 1/2004 | Bangert | 297/316 |
| 7,596,820 | B2 * | 10/2009 | Nielsen et al. | 5/618 |
| 2004/0262587 | A1 | 12/2004 | Dewert | |
| 2008/0121852 | A1 * | 5/2008 | Koch | 254/100 |

FOREIGN PATENT DOCUMENTS

| | | |
|---|---|---|
| CH | 328999 | 5/1958 |
| DE | 29607493 | 8/1996 |
| DE | 29907818 | 8/1999 |
| DE | 29908361 | 9/1999 |

(Continued)

OTHER PUBLICATIONS

English Abstract of DE20315919, Jan. 2004.

(Continued)

*Primary Examiner* — Matthew D Troutman
(74) *Attorney, Agent, or Firm* — Dykema Gossett PLLC

(57) ABSTRACT

An item of furniture includes a frame mounting two adjustable sections which each includes a pivot shaft to cause pivoting of the respective section relative to the frame. Each pivot shaft mounts a claw-shaped arm having two legs. A dual linear actuator having openings at its opposite ends is suspended from the two claw-shaped arms and is operable to rotate the pivot shafts by engagement of sliding spindle nuts therein with the respective claw-shaped arms.

3 Claims, 3 Drawing Sheets

FOREIGN PATENT DOCUMENTS

| | | | |
|---|---|---|---|
| DE | 29913708 | | 11/1999 |
| DE | 20315919 | | 1/2004 |
| DE | 10240230 | | 3/2004 |
| DE | 202004007564 | | 7/2004 |
| DE | 20309044 | | 10/2004 |
| WO | WO 2005122841 | A1 * | 12/2005 |

OTHER PUBLICATIONS

English Abstract of DE20309044, Oct. 2004.
Translation of DE29908361, Sep. 1999.
English Abstract of DE202004007564, Jul. 2004.
English Abstract of DE10240230, Mar. 2004.

* cited by examiner

PIECE OF FURNITURE SUCH AS A BED OR A CHAIR

BACKGROUND OF THE INVENTION

1. Field of the Invention

The present invention relates to a piece (or item) of furniture such as a bed or a chair.

2. The Prior Art

For explanation of the invention reference is made to WO 03/04 5195 A1 Cimosys Limited which deals with a bed with an adjustable backrest and legrest section embedded in a frame. For elevating the backrest section in a pivoting manner, there is a transverse pivot shaft embedded in the frame, the pivot shaft having at each end a lever which with an end engages the backrest section. In a similar manner there is a pivot shaft and lever for moving the legrest section. A drive unit with a linear drive at each end is mounted on the two pivot shafts. The linear drives have a spindle with a nut designed as a sliding element, the sliding elements being engaged with a short arm secured to the respective pivot shafts. The arm is claw-shaped and sits astride the spindle facing an end of the sliding element. Traditionally, the arm consists of two individual plate elements separately welded onto the pivot shaft at a certain mutual distance, cf. for example U.S. Pat. No. 6,300,732 B1 Compact srl. It is decisive for the function that the two plate elements of the arm are placed in a correct angle and distance on the shaft and with a correct mutual distance between them. This question is among other things the object for DE 203 15 919 U1 Standswerk Wetter Sichelschmidt GmbH & Co. KG, in which a distance part is inserted between the two plate elements in order to ensure the correct mutual distance. Subsequently, Standswerk Wetter Sichelschmidt GmbH & Co. KG has suggested in DE 203 09 044 U1 to construct the claw-shaped arm as a forged part, which is rather demanding. A further issue is also a robust and rigid fixing of the arms to the pivot shafts as the arms are heavy loaded.

The object of the invention is to provide a claw-shaped arm which combines a robust and rigid fixing with a simple and inexpensive manufacturing and further provides in an easy manner a correct location of the arm.

SUMMARY OF THE INVENTION

This is achieved according to the invention with an embodiment in which the claw-shaped arm is as a single component cut out and bent from a plate material. This is a simple and inexpensive manufacturing method which simultaneously provides a possibility for a good welding onto the shaft. At the same time, a correct distance between the two legs of the claw-shaped arm is ensured.

In a preferred embodiment there is in the upper end of claw-shaped arm a notch for receiving the pivot shaft, which makes it easy to place it on the pivot shaft. Preferably, the notch is semicircular corresponding to the outer diameter of the pivot shaft having the additional advantage of a long contact surface providing good basis for a stable fixing to the pivot shaft. In a further embodiment the upper part of the claw-shaped arm has a rectilinear plate running parallel to the pivot shaft which presents an alternative for fixing the claw-shaped arm to the pivot shaft. When the notch or notches are so deep and situated so that the rectilinear plate element abuts the shaft, this provides an additional possibility for fixing the claw-shaped arm to the pivot shaft.

To make the upper part of the claw shaped arm rigid the side members from which the legs stretches out could have a side flap bend towards each other. Also having the rectilinear plate element the flaps are running parallel to this. Further rigidity could be obtained by that the ends of the two flaps joints and are welded together.

In a further preferred embodiment the legs of the claw shaped arm are hardened which minimizes wear from the engagement with the sliding element whereas the upper part is not hardened which makes the welding easier.

An embodiment of the invention will be explained in greater detail in the following with reference to the accompanying drawings.

DETAILED DESCRIPTION OF THE PREFERRED EMBODIMENT

Figure 1:
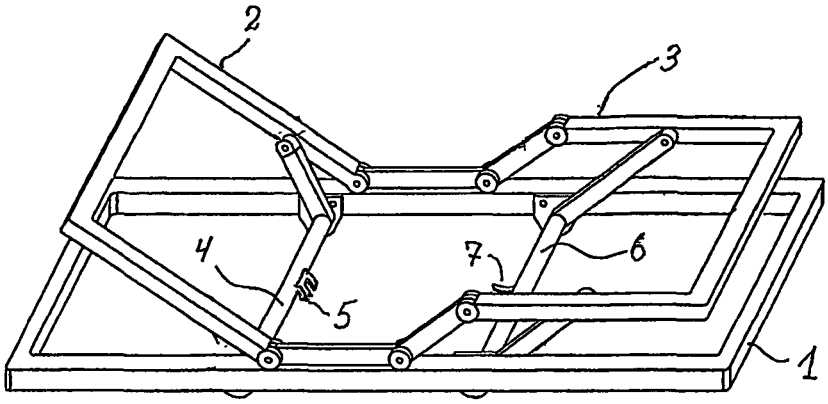
FIG. 1 shows a slatted bed with raised backrest and legrest section.

As it appears from FIG. 1, the slatted bed comprises a frame 1 in which a backrest section 2 and an articulated legrest section 3 is embedded. For the backrest section 2 a transverse pivot shaft 4 with a short arm 5 fixedly mounted onto it is embedded in the frame. Correspondingly, there is a shaft 6 with a short arm 7 for the legrest section.

Figure 2:
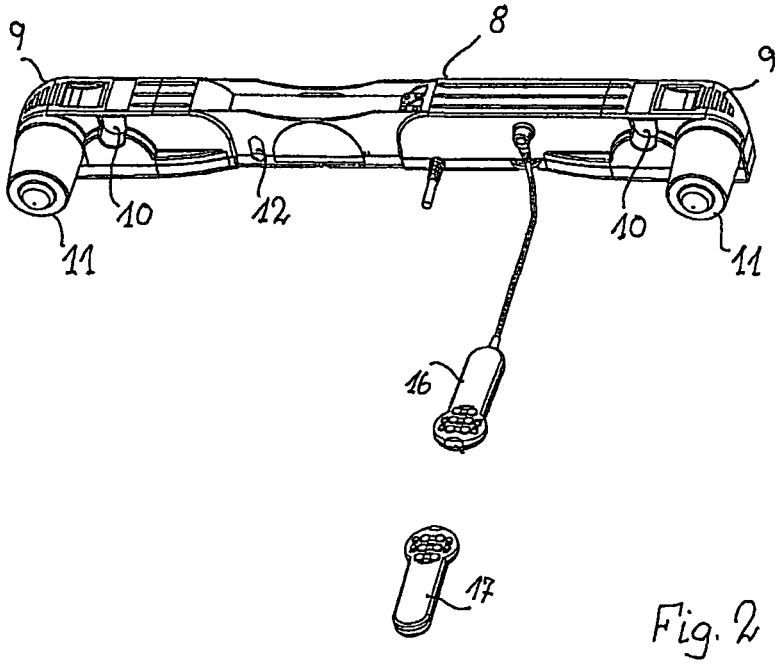
FIG. 2 shows a perspective view of a dual actuator.

The movement of the backrest and legrest section 2,3 is obtained with a drive unit in the nature of a dual linear actuator as shown in FIG. 2. The drive unit comprises a housing 8 with a sliding cover 9 at each end, the covers giving access to an opening 10 for the respective pivot shafts 4,6. In connection with the shaft openings 10 there is a linear drive driven by a motor 11 mounted perpendicular to the housing. Over a worm gear, the motor drives a spindle with a spindle nut designed as a sliding element 12. The sliding element is fixed against rotation in the housing 8 and by rotation of the spindle the sliding element 12 is moved back and forth depending on the rotary direction of the spindle. As the arm 5 on the pivot shaft 4 of the backrest section engages the end of the sliding element 12, the backrest section is in a pivoting manner elevated up and down, respectively. Correspondingly, the linear drive in the other end of the drive unit operates the legrest section.

The drive unit is mounted on the slatted bed by pulling the covers 9 outwards from the end of the drive unit, and leading the drive unit in until the pivot shafts 4, 6 rest in the openings 10 and the arms 5, 7 located inside the drive unit. The covers 9 are shut again, by means of which the actuator hangs on the pivot shafts 4, 6. When the linear drives are activated, the pivot shafts are turned as the sliding elements 12 of the respective linear drives engages the arms 5, 7, which causes the backrest and the legrest section respectively to be raised or lowered.

Figure 4:
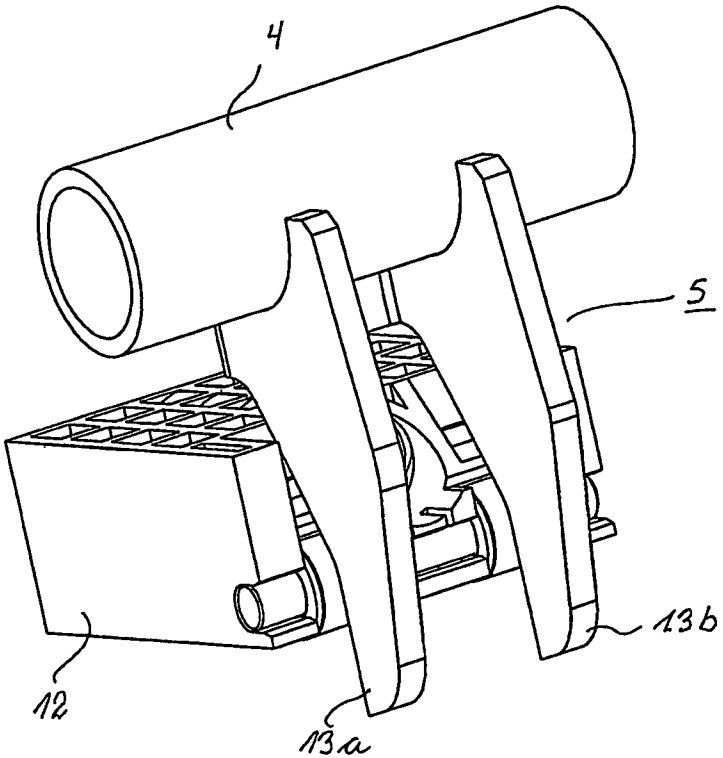
FIG. 4 shows the claw-shaped arm engaged with a spindle nut in the actuator constructed as a sliding element.
Figure 3:
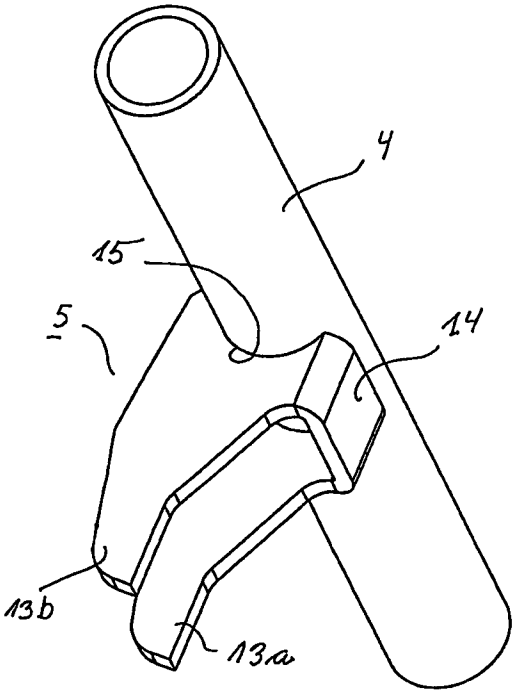
FIG. 3 shows a claw-shaped arm shown perspectively mounted on a pivot shaft.
Figure 3A:
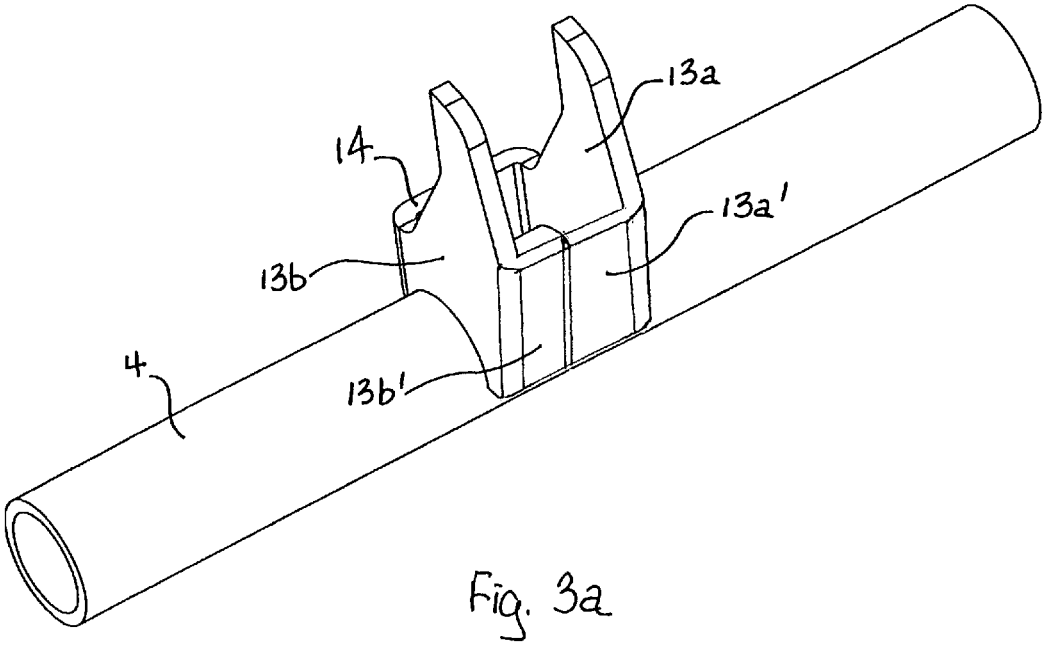
FIG. 3*a* shows a different perspective view thereof.

As it appears from FIGS. 3, 3*a* and 4, the arm 5 on the pivot shaft 4 of the backrest section 2 is punched and folded in one operation from a plate element as a single component. The arm is designed as a claw with two legs 13*a*, 13*b*, connected by a interconnecting element 14 at the top. In the top part 13*a*, 13*b* of the legs there is a semicircular notch 15 for receiving the tube-shaped pivot shaft 1. The claw is welded onto the pivot shaft 1 along the notch 15 and by the upper edge of the interconnection element 14.

As seen in FIG. 3*a*, at the opposite side of the interconnecting element 14 the legs can have two flaps 13*a*' and 13*b*' which are bent towards each other and welded together to form a corresponding interconnecting element, which for one thing helps stabilize the legs but also provides the possibility for a further welding to the shaft 4.

The arm 7 on the pivot shaft 6 of the legrest section is constructed accordingly.

The spindles rotated by motors 11 extend through the associated sliding element 12 and between the legs 13*a*, 13*b* of the associated arm 5,7.

Thus, with the invention a claw-shaped arm is created through a simple punching and bending process. The arm can be secured to the pivot shaft in a robust and rigid manner by means of suitable welding. Further, the leg portions 13*a*, 13*b* could be hardened to resist wear caused by engagement with the sliding element 12 of the drives.

Just to complete for the adjustment of the backrest and legrest sections 2, 3, the drive unit 8 could be operated by a cable connected remote control 16 as well by a IR remote control 17.

Just to complete for the adjustment of the backrest and legrest sections 2, 3 the drive unit 8 could be operated by a cable connected remote control 16 as well by a IR remote control 17.

The invention claimed is:

1. An item of furniture which comprises:

a frame, first and second adjustable sections rotatably attached to said frame, first and second pivot shafts respectively connected to said frame for rotating said first and second adjustable sections relative to said frame, first and second claw-shaped arms respectively mounted on said first and second pivot shafts, each of said first and second claw-shaped arms being cut out and bent from a plate material and defining first and second legs having corresponding semicircular notches positioned against and welded to the respective pivot shaft, an interconnecting portion adjacent the semicircular notches therein connecting said first and second legs, and flaps bent towards each other from respective first and second legs, said respective flaps being welded together to provide stability to said respective first and second legs, a dual linear actuator connected to and suspended from said first and second claw-shaped arms, said dual linear actuator comprising an elongated housing having openings at opposite ends thereof for said respective first and second claw-shaped arms, a cover at said opposite ends for closing a respective opening, dual motors, a respective spindle driven by each motor, and a sliding spindle nut driven by each motor and engageable with the legs of a respective claw-shaped arm for rotating a respective adjustable section relative to said frame, each respective spindle extending through a respective spindle nut and between the first and second legs of the respective claw-shaped arm.

2. The item of furniture according to claim 1, wherein the interconnecting portion of each of said first and second claw-shaped arms is respectively welded to said first and second pivot shafts.

3. The item of furniture according to claim 1, wherein each said interconnecting portion is welded to a respective pivot shaft.

* * * * *

UNITED STATES PATENT AND TRADEMARK OFFICE

CERTIFICATE OF CORRECTION

PATENT NO. : 8,500,202 B2
APPLICATION NO. : 12/223931
DATED : August 6, 2013
INVENTOR(S) : Nielsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 747 days.

Signed and Sealed this
Fifteenth Day of September, 2015

Michelle K. Lee

Michelle K. Lee
*Director of the United States Patent and Trademark Office*